US012280421B2

(12) United States Patent
Boone

(10) Patent No.: US 12,280,421 B2
(45) Date of Patent: Apr. 22, 2025

(54) MOLTEN METAL FILTER DEVICE FOR CASTING VEHICLE COMPONENTS

(71) Applicant: GM Global Technology Operations LLC, Detroit, MI (US)

(72) Inventor: Thomas J. Boone, Ann Arbor, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 18/340,226

(22) Filed: Jun. 23, 2023

(65) Prior Publication Data

US 2024/0424551 A1 Dec. 26, 2024

(51) Int. Cl.
*B22C 9/08* (2006.01)
*B22D 11/119* (2006.01)
*C22B 9/02* (2006.01)

(52) U.S. Cl.
CPC ..... *B22C 9/086* (2013.01); *B22D 11/119* (2013.01); *C22B 9/023* (2013.01)

(58) Field of Classification Search
CPC ..... B22C 9/086; B22D 11/119; B22D 43/004; C22B 9/023; C22B 21/066
USPC ..... 266/227
See application file for complete search history.

(56) References Cited

U.S. PATENT DOCUMENTS 4,515,630 A * 5/1985 Tyler ..... C22B 23/06 266/216
5,114,472 A * 5/1992 Eckert ..... C22B 9/023 75/412
5,322,546 A * 6/1994 Holsgrove ..... B22D 43/004 75/412
5,891,215 A 4/1999 Meseha et al.
6,290,900 B1 * 9/2001 Hatano ..... C22B 21/064 266/208
6,500,228 B1 * 12/2002 Klingensmith ..... F27B 3/19 266/94
6,503,292 B2 * 1/2003 Klingensmith ..... F27D 3/14 266/94
6,585,797 B2 * 7/2003 Kinosz ..... B22D 39/00 75/681

FOREIGN PATENT DOCUMENTS

CA 1180532 A 1/1985
DE 69323210 T2 6/1999
(Continued)

*Primary Examiner* — Jessee R Roe
*Assistant Examiner* — Michael Aboagye
(74) *Attorney, Agent, or Firm* — Vivacqua Crane, PLLC

(57) ABSTRACT

A molten aluminum metal filter system having a holding tank operable to receive a molten metal, a filter device to filter the molten metal, a pump operable to continuously recirculate the molten metal through the filter device, and a casting device to receive a filtered molten metal from the filter device. The filter device includes a chamber, an inlet channel operable to convey the molten metal into the chamber, and an outlet channel operable to convey unused filtered molten metal out of the chamber and back into the holding tank. Removeable filter elements are disposed in series within the inlet channel. The removable filter elements are configured to remove inclusions above a determined diameter size from the molten metal. The filter device includes at least one nozzle operable to direct an inert gas flow to blanket the molten metal and a heating element.

20 Claims, 5 Drawing Sheets

(56) References Cited

FOREIGN PATENT DOCUMENTS

| | | | |
|---|---|---|---|
| EP | 3631028 | B1 | 4/2021 |
| NO | 318003 | B1 | 1/2005 |
| WO | 2016126165 | A1 | 8/2016 |

* cited by examiner

MOLTEN METAL FILTER DEVICE FOR CASTING VEHICLE COMPONENTS

INTRODUCTION

The present disclosure relates to casting of vehicle components, more particularly, to a molten metal alloy filter device for casting of vehicle components.

Casting is a process that is characterized by flowing a molten metal alloy into a mold cavity having a predetermined shape of a desired cast component. High pressure die casting (HPDC) and low pressure die casting (LPDC) processes are typically used in the automotive industry for casting vehicle components, particularly those of ultra-large cast components. Ultra-large cast components, also referred to as ultra-large castings, allow vehicles to be lighter and less complex to manufacture by replacing large numbers of stamped panels with a single piece ultra-large casting. These ultra-large castings are often referred to as mega-castings or giga-castings due to the huge size of the die casting machines used to make these castings. As a non-limiting example, a single piece ultra-large casting can have a width of at least 0.8 meter (m), a length of at least 1 m, and a height of at least 0.25 m.

In the automotive industry, molten casting aluminum alloys are normally subjected to a rotary degassing process before being injected into a die-casting mold. The rotary degassing process injects an inert gas, such as argon or nitrogen, into the molten metal casting aluminum alloys through a rotating graphite shaft in order to reduce contaminates such as hydrogen gas and aluminum oxides, both of which can cause porosity and other inclusions in the solidified castings.

Thus, while rotary degassing of molten casting alloys achieve their intended purpose, there is a continued need to further improve the quality of the molten alloys with respect to eliminating undesirable contaminates prior to introducing the molten alloys into the casting molds in the manufacturing of ultra-large cast vehicle components.

SUMMARY

According to several aspects, a molten metal filter device is disclosed. The molten metal filter device includes a housing having an interior surface defining an inlet channel, an outlet channel, and a chamber in fluid communication with the inlet channel and the outlet channel. A first filter element disposed in the inlet channel. The inlet channel is configured to convey a molten metal into the chamber and the outlet channel is configured to direct the molten metal out of the chamber. The first filter includes a form factor occupying a cross-section of the inlet channel perpendicular to the direction of flow of the molten metal through the inlet channel. The first filter is operable to filter the molten metal to produce a filtered molten metal.

In an additional aspect of the present disclosure, the chamber is accessible to transfer a portion of the filtered molten metal from the chamber to a casting device.

In another aspect of the present disclosure, the molten filter device further include a nozzle operable to direct an inert gas flow into at least one of the inlet channel and the outlet channel to blanket the molten metal.

In another aspect of the present disclosure, a second filter element disposed in the inlet channel downstream of the first filter element.

In another aspect of the present disclosure, the outlet channel is immediately adjacent to the inlet channel and separated by a heat energy conductive partition wall.

In another aspect of the present disclosure, the outlet channel is configured to convey the molten metal in a direction counter-current to the direction of flow of the molten metal through the inlet channel.

In another aspect of the present disclosure, the molten metal filter device further includes at least one pump in fluid communication with at least one of the inlet channel and the outlet channel.

In another aspect of the present disclosure, the at least one pump includes an upstream pump in fluid communication with the holder and inlet channel, and a downstream pump in fluid communication with the outlet channel and the holder. The upstream pump is operable to draw the molten metal from the holder and pushes the molten metal through the inlet channel. The downstream pump is operable to draw the molten metal from the outlet channel and pushes the molten metal to the holder.

In another aspect of the present disclosure, the molten metal filter device further includes a hood covering at least one of the inlet channel and the outlet channel. The hood includes a removeable hatch to allow access to selectively remove the first filter element.

In another aspect of the present disclosure, the molten metal filter device further includes a heating element disposed within the hood and overhead at least one of the inlet channel and the outlet channel.

According to several aspects, a molten metal filter system is disclosed. The system includes, a holding tank operable to receive a molten metal; a filter device comprising a chamber, an inlet channel operable to receive the molten metal from the holding tank and convey the molten metal into the chamber, and an outlet channel operable to convey the molten metal out of the chamber and back into the holding tank; a pump operable to move the molten metal from the holding tank through the inlet channel; and a plurality of removeable filters disposed in series within the inlet channel. The plurality of removable filters are operable to remove inclusions above a determined diameter size from the molten metal.

In an additional aspect of the present disclosure, the outlet channel is in thermal communication with the inlet channel. The direction of flow of the molten metal through the outlet channel is counter-current to a direction of flow of the molten metal through the inlet channel.

In another aspect of the present disclosure, at least one of the plurality of removeable filters includes at least one of a zirconium silicate, zirconium oxide, and silicon carbide, and a pore size sufficient to remove particles size of about 20 microns and greater than 20 microns.

In another aspect of the present disclosure, the filter device includes at least one nozzle operable to direct an inert gas flow into at least one of the inlet channel and the outlet channel to blanket the molten metal.

In another aspect of the present disclosure, the chamber is accessible to transfer a filtered molten metal from the chamber to a casting device.

According to several aspects, a continuous flow molten metal filter system is closed. The system includes a filter device operable to filter a molten casting alloy to produce a filtered molten casting alloy and a casting device operable to receive the filtered molten casting alloy to form a solidified casting. The filter device includes an inlet channel, a chamber downstream of the inlet channel, an outlet channel downstream of the chamber, and at least one removable filter disposed in the inlet channel.

In an additional aspect of the present disclosure, the system further includes a pump operable to continuously recirculate the molten metal through inlet channel, chamber, and outlet chamber.

In another aspect of the present disclosure, the inlet channel is in thermal communication with the outlet channel. The direction of flow of the molten casting alloy in the outlet channel is counter-current to a direction of the flow of the molten casting alloy in the inlet channel.

In another aspect of the present disclosure, the filter device includes at least one nozzle operable to direct an inert gas flow into at least one of the inlet channel and the outlet channel to blanket the molten casting alloy.

In another aspect of the present disclosure, the chamber is accessible to transfer a filtered molten metal from the chamber to the casting device.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses. The illustrated embodiments are disclosed with reference to the drawings, wherein like numerals indicate corresponding parts throughout the several drawings. The figures are not necessarily to scale, and some features may be exaggerated or minimized to show details of particular features. The specific structural and functional details disclosed are not intended to be interpreted as limiting, but as a representative basis for teaching one skilled in the art as to how to practice the disclosed concepts.

Figure 1:
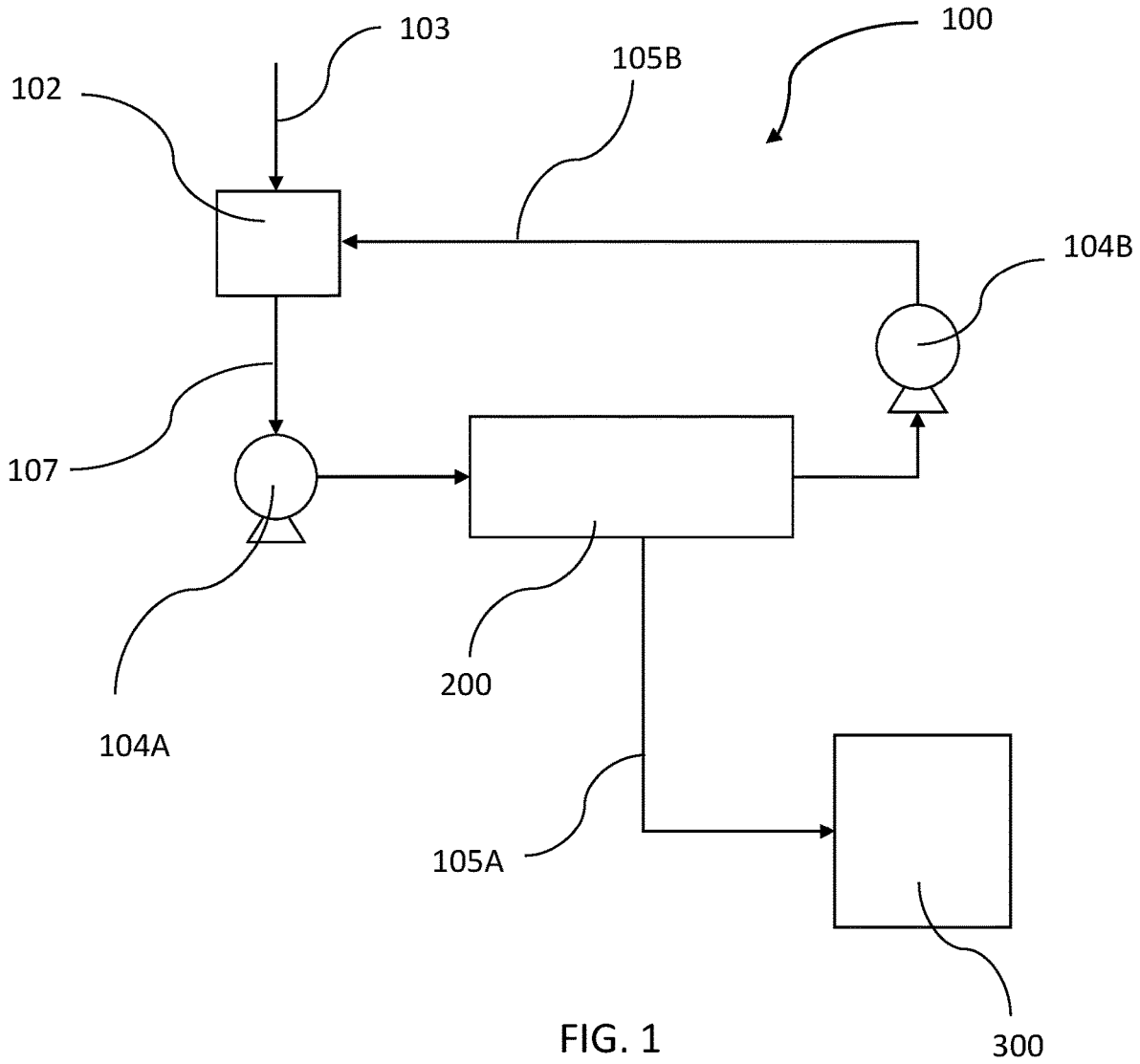
FIG. 1 is a schematic illustration of a casting system having a continuous recirculating filter device.

FIG. 1 is a schematic illustration of a die-casting system 100 having a continuous recirculating molten metal alloy filter device 200. The die-casting system 100 includes a holding tank 102, the molten metal alloy filter device 200, and a die-casting device 300. For brevity, the die-casting system 100 is also referred to as the system 100, the holding tank 102 is also referred to as the holder 102, and the molten metal alloy filter device 200 is also referred to as the filter device 200. The system 100 further includes at least one transfer pump 104A, 104B operable to continuously recirculate a molten metal alloy through the filter device 200. The molten metal alloy is also referred to as a molten metal or molten alloy. A first portion 105A of the filtered molten alloy from the filter device 200 is fed to the die-casting device 300 and a remaining second portion 105B of the filtered molten alloy from the filter device 200 is transferred to the holder 102 to be recirculated through the filter device 200.

In the non-limiting example shown, the holder 102 is configured to receive an unfiltered molten alloy 103 from a molten alloy source (not shown) and the second portion 105B of the filtered molten alloy from the filter device 200. A mixture of unfiltered molten alloy 103 and filtered molten alloy 105B is referred to as a partially filtered molten alloy 107. In one embodiment, the at least one transfer pump 104A, 104B includes only an upstream transfer pump 104A, also referred to as a first pump 104A, operable to draw the partially filtered molten alloy 107 from the holder 102 and pushes the partially filtered molten alloy 107 through the filter device 200. In another embodiment, the at least one transfer pump 104A, 104B includes only a downstream transfer pump 104B, also referred to as a second pump 104B, operable to draw the second portion 105B of filtered molten alloy from the filter device 200 and pushes the second portion 105B of filtered molten alloy to the holder 102 to be recirculated through the filter device 200. In yet another embodiment, the at least one transfer pump 104A, 104B includes both the upstream pump 104A and the downstream pump 104B. The upstream pump 104A coordinates with the downstream pump 104B to provide a consistent predetermined flowrate through the filter device 200 by balancing the flow of the partially filtered molten alloy 107 into the filter device 200 and the flow of the second portion 105B of filtered molten alloy out of the filter device 200.

Figure 2A:
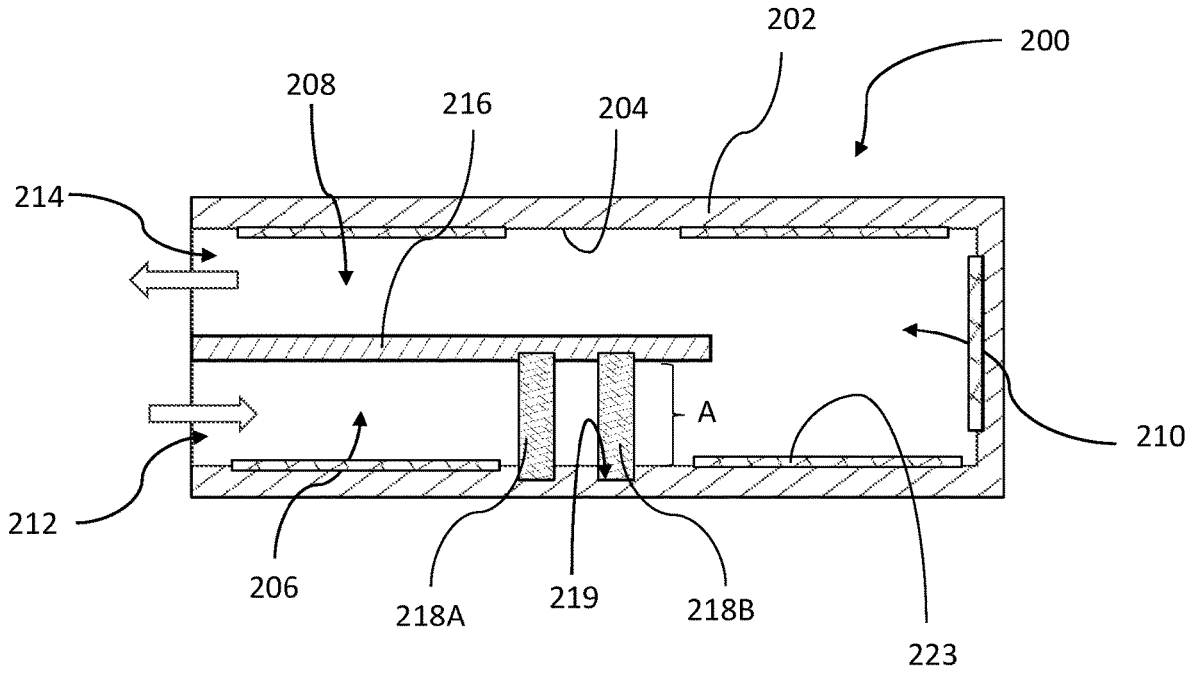
FIG. 2A is a diagrammatic cross-sectional plan view of the filter device.

FIG. 2A is a diagrammatic cross-sectional plan view of the filter device 200. The filter device 200 includes a housing 202 having an interior surface 204 defining an inlet channel 206, an outlet channel 208 and a chamber 210 in fluid communication with both the inlet channel 206 and the outlet channel 208. The inlet channel 206 includes an inlet port 212 for receiving a flow of molten metal from the holder 102. The outlet channel 208 includes an outlet port 214 in fluid communications with the holder 102. The molten metal flows from the holder 102 through the inlet channel 206 and into the chamber 210. From the chamber 210, the molten metal flows through the outlet channel 208 and back to the holder 102, or transferred from the chamber 210 to the die-casting device 300.

A plurality of removable filter elements such as a first filter element 218A and a second filter element 218B are disposed in series within the inlet channel 206 to filter the molten alloy flowing through the inlet channel 206 to the chamber 210. The first and second filter elements 218A, 218B have a form factor adapted to fill a cross-sectional area (A) of the inlet channel 206 perpendicular to the direction of the molten alloy flow within the inlet channel 206. The interior surface 204 of the housing 202 may also define slots 219 to receive the filter elements 218A, 218B. The filter elements 218A, 218B may be manufactured of materials including, but not limited to, zirconium silicate, zirconium oxide, silicon carbide, and other materials capable of withstanding the temperature and flow of the molten alloy while filtering out contaminates above a predetermined diameter size.

For Aluminum-Silicon (Al—Si) casting alloys, it is desirable for the filter elements 218A, 218B to have a pore size such that of about 20 microns in diameter to remove undesirable contaminates larger than 20 microns such as slag dross, foam, and oxides from the molten alloy flow. Such contaminates may cause porosity and other undesirable inclusions in the solidified castings. Another benefit is that the filter elements 218A, 218B facilitate a homogenization of the alloying elements within the molten metal and turn turbulent flows into laminar flows by decelerating the molten metal flow as the molten metal moves through the filter device 200. This results in significantly smaller size contaminates entering into the die-casting device 300. The pores of the filter elements 218A, 218B may have predetermined shapes to increase the useful life of the filter elements 218A, 218B without plugging. The filter elements 218A, 218B may be manufactured by additive manufacturing such as three-dimensional (3-D) printing.

In the non-limiting example shown, the inlet channel 206 is adjacent to the outlet channel 208 and is separated from the outlet channel 208 by a heat energy conductive partition wall 216. The inlet channel 206 is in thermal communication with the outlet channel 208, meaning that heat energy is transferred through the partition wall 216 between the molten metal flowing through the inlet channel 206 and the outlet channel 208. The molten metal flowing through the outlet channel 208 back to the holder 102 is in a direction counter-current to the flow of the molten metal flowing through the inlet channel 206 from the holder 102. The counter-current flow of the molten metal within the inlet channel 206 and outlet channel 208 enables a continuous molten metal flow through the filter elements 218A and 218B while minimizing temperature drop. The continuous counter-current flow extends the operating life of the filter elements 218A, 218B by preventing premature plugging of the filter elements 218A, 218B.

Figure 2B:
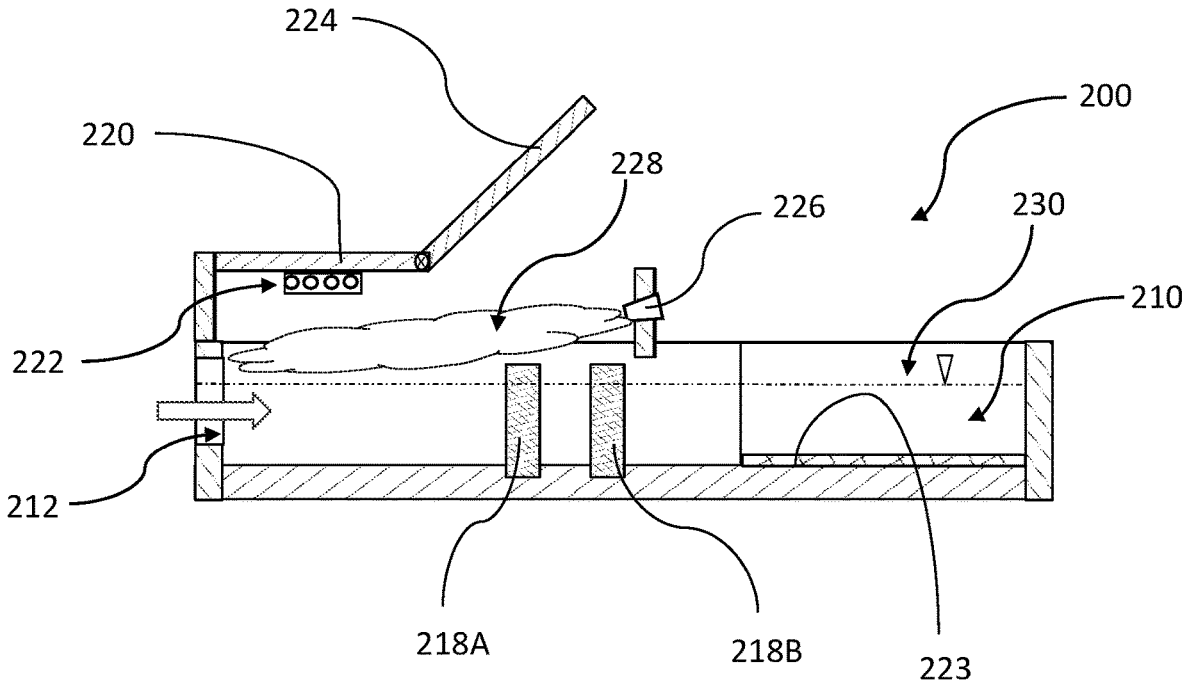
FIG. 2B is a diagrammatic cross-sectional elevation view of the filter device.

FIG. 2B is a diagrammatic cross-sectional side elevation view of the filter device 200. The chamber 210 is accessible for continuous or batch dispensing of a filtered molten metal into the die-casting device 300 via a ladle, a stopper rod, a launder, or other known methods of withdrawing molten metal. The filter device 200 includes a cover 220 or hood 220 over the inlet channel 206 and the outlet channel 208 to minimize heat energy loss from the molten metal. Overhead heating elements 222 are provided within the covered portion to maintain the temperature of the molten metal. Non-limiting examples of overhead heating elements 222 includes radiator type heaters, gas fired tubular heaters, and electrical resistance heating elements. A portion of the interior surface 204 of the filter device 200 may be lined with refractory materials 223 to minimize heat loss of the molten metal.

An access hatch 224 is provided in the cover 220 to allow for access to the plurality of filter elements 218A, 218B. The filter elements 218A, 218B may be selectively removed and replaced through the access hatch 224. At least one nozzle 226 is disposed within the hood 220 and is configured to direct an inert gas 228, such as nitrogen or argon, into at least one of the inlet channel 206 and the outlet channel 208 to blanket the surface 230 of the molten metal flow. The inert gas 228, also referred to as a cover gas, inhibits the formation of fresh oxides on the surface of the molten metal flow, where the molten metal is exposed to air.

Figure 3:
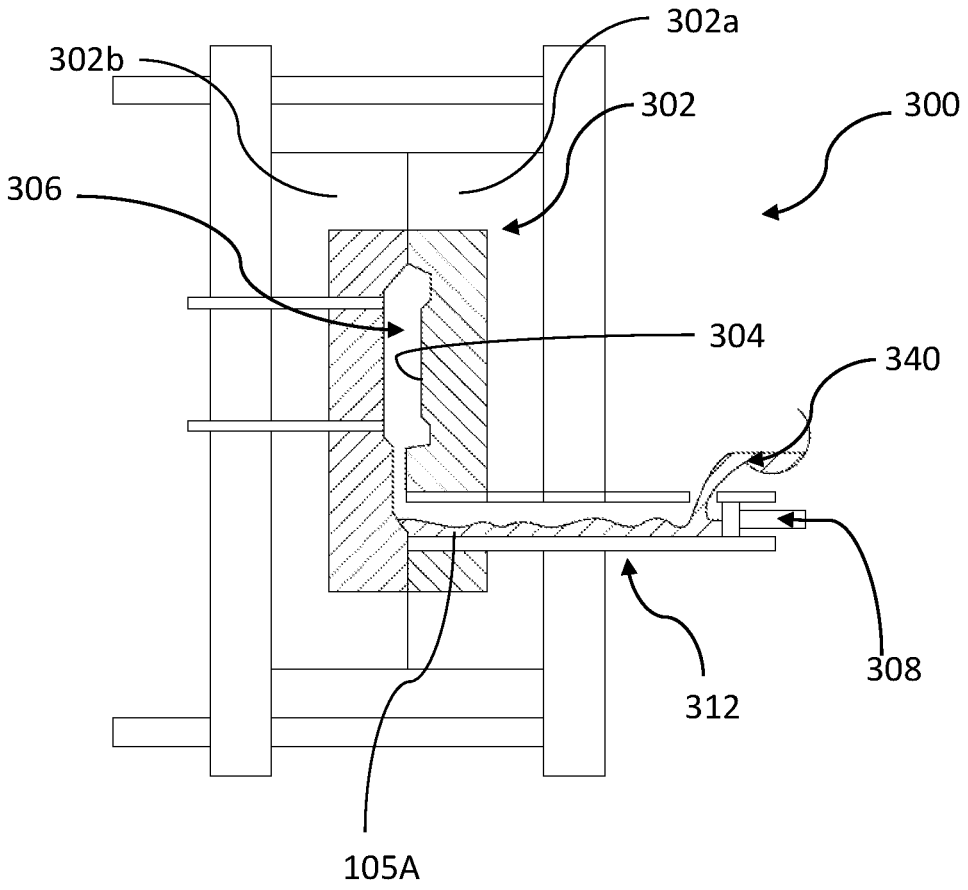
FIG. 3 is a diagrammatic illustration of a casting device.

FIG. 3 is a diagrammatic illustration of the die-casting casting device 300. The die-casting device 300 includes a die-casting mold 302 having an interior surface 304 defining a mold cavity 306. The mold cavity 306 is configured to receive the filtered molten metal from the chamber 210 of the filter device 200 to form an ultra-large casting having a predetermined shape of the mold cavity 306. The die-casting device 300 also includes a plunger mechanism 308 and/or a pouring mechanism 340 for transferring molten metal to the shot sleeve system 312 for delivering the filtered molten metal to the mold cavity 306. The mold 302 is typically formed of two pieces 302*a*, 302*b*, in which one is a stationary piece 302*a* and the other is a moveable piece 302*b* constructed to facilitate the removal of the solidified casting. The lower oxide particle size and content of the filtered alloy 105A improves the mechanical properties such as the ultimate tensile strength, yield strength, percent elongation, and fatigue life of the solidified casting. The increase in percent elongation have the potential to eliminate heat treatment for some casting component applications. Ultra-low oxide content will increase overall desirable material properties. While a die-casting device 300 is described, it should be appreciated that the die-casting device 300 may be any casting device or casting molds capable of receiving a filtered metal alloy 105A to form a solidified objects. Other objects include, but are not limited to, ingots, sows, bars, and similar aluminum raw materials. Other casting devices include, but not limited to, semi-permanent mold (SPM), sand casting, lost foam, investment casting. The filter device 200 can be used for any casting process which uses molten aluminum.

Referring to FIGS. 1-3, in an unlimiting example of the operation of the system 100, at start up, an unfiltered molten metal 103 is introduced into the holder 102. The upstream pump 104A draws the unfiltered molten metal 103 from the holder 102 and pushes the unfiltered molten metal 103 through the inlet channel 206 and filters 218A and 218B to produce a filtered molten metal 105A. On a continuous or batch process, predetermined quantities of filtered molten metal 105A are transferred from the chamber 210 of the filter device 200 to the die-casting device 300. The remaining portion of the filtered metal 105B flows through the chamber 210 and out of the filter device 200 through the outlet channel 208. The downstream pump 104B draws the unused filtered molten metal 105B from the chamber 210 and transfers the unused filtered molten 105B through the outlet channel 208 to the holder 102. During steady state operations, the molten metal in the holder 102 is continuously replenished with the unfiltered molten metal 103 in an amount equal to the amount of filtered molten metal 105A removed from the filter device 200, thus forming a mixture of filtered and unfiltered metal alloy 107 in the holder 102. The mixture of unfiltered and filtered molten metal 107 from the holder 102 is continuously recirculated through the filter device 200 to provide the filtered molten metal 105A for the casting device.

Figure 4:
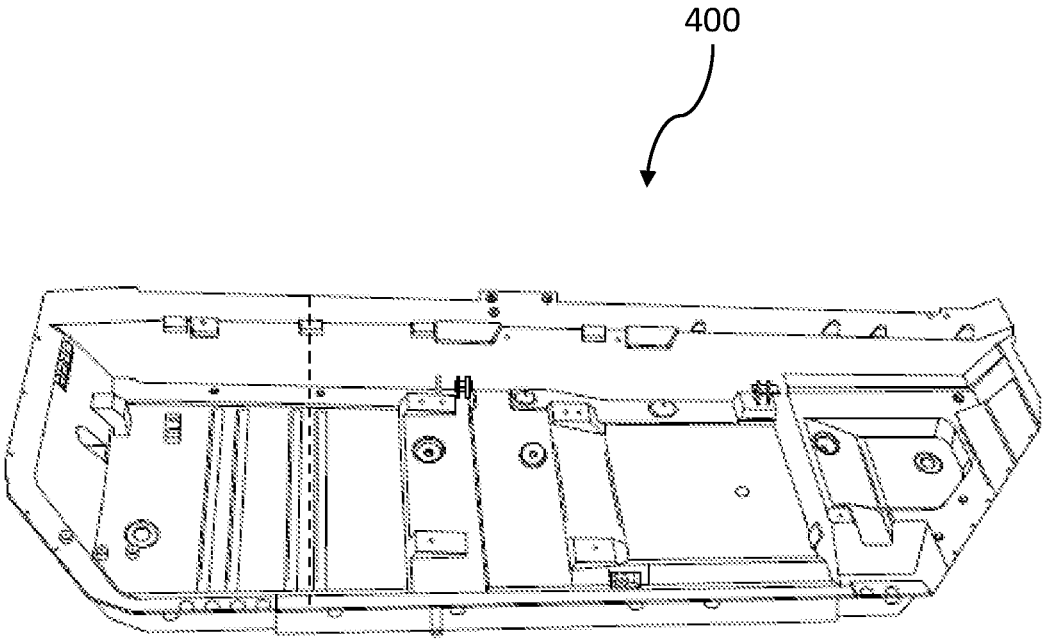
FIG. 4 is an illustration of an exemplary ultra-large casting of a body component for a vehicle.

FIG. 4 is an illustration of a non-limiting example of an ultra-large casting 400 for a vehicle manufacturable by the system 100. The ultra-large casting 400 shown is that of a structural body floor panel of the vehicle. Other examples of structural ultra-large castings includes, but are not limited to body panels, battery trays, and other load bearing components that have varying cross-sectional thicknesses. The ultra-large casting 400 may be designed and manufactured for on-road vehicles such as passenger car, motorcycles, trucks and trailers, sport utility vehicles (SUVs), and recreational vehicles (RVs), and off-road vehicles such as marine vessels and aircrafts, commercial trucks.

As a non-limiting example, the ultra-large casting 400 is manufacturable by casting an aluminum-silicon (Al—Si) based alloy using the system 100. The molten Al—Si alloy is filtered by the filter device 200 to remove any impurities, oxides, and other particles larger than about 20 microns to provide a homogenous casting alloy to the die-casting device 300. The device could be used to filter out particles as low as 5 microns for aluminum based alloy not containing silicon. The filtered molten metal 105A is injected by the plunger mechanism 308 through the shot sleeve system to fill the mold cavity 306 within a prescribed time and pressure. The molten metal is cooled to solidification in the mold 302 and ejected from the mold 302. The ejected solidified casting 400 is then machined to design dimensions and tolerances, and heat treated as necessary to desired specifications.

Ultra-large castings manufactured with a filtered casting alloy have ultra-low oxide content thus providing superior mechanical properties. An inclusion content less than 12 $mm^2/kg$ based on Porous Disk Filtration Analysis (PODFA) is considered to be ultra-low oxide content in the metal casting industry. The ultimate tensile strength, yield strength, percent elongation, and fatigue life are improved over the current casting alloy material properties used in computer-aided-design (CAD). Higher as-cast percent elongations may eliminate the need for heat treatment of some applications. Ultra-low oxide content improves fatigue properties and would permit more lightweighting of components, which improves vehicle mileage (range), reduces emissions, and reduces the material cost of the components.

The description of the present disclosure is merely exemplary in nature and variations that do not depart from the general sense of the present disclosure are intended to be within the scope of the present disclosure. Such variations are not to be regarded as a departure from the spirit and scope of the present disclosure.

What is claimed is:

1. A molten metal filter device, comprising:

a housing having an interior surface defining an inlet channel, an outlet channel, and a chamber in fluid communication with the inlet channel and the outlet channel, wherein the inlet channel is configured to convey a flow of molten metal into the chamber and the outlet channel is configured to direct the flow of molten metal out of the chamber;

a heat conductive partition wall disposed between the inlet channel and the outlet channel, wherein the outlet channel is operable to convey the flow of molten metal in a direction counter-current to the direction of the flow of molten metal through the inlet channel, and a first filter element disposed in the inlet channel, wherein the first filter element includes a form factor occupying a cross-section of the inlet channel perpendicular to a direction of the flow of molten metal through the inlet channel.

2. The molten metal filter device of claim 1, wherein the chamber is accessible to transfer a portion of the molten metal from the chamber to a casting device.

3. The molten metal filter device of claim 1, further comprising a nozzle operable to direct an inert gas flow into at least one of the inlet channel and the outlet channel to blanket the molten metal.

4. The molten metal filter device of claim 1, further comprising a second filter element disposed in the inlet channel downstream of the first filter element.

5. The molten metal filter device of claim 1, further comprising at least one pump in fluid communication with at least one of the inlet channel and the outlet channel.

6. The molten metal filter device of claim 5, wherein the at least one pump comprises:

an upstream pump in fluid communication with the inlet channel, wherein the upstream pump is operable to pushes the molten metal through the inlet channel; and a downstream pump in fluid communication with the outlet channel, wherein the downstream pump is operable to draw the molten metal from the outlet channel.

7. The molten metal filter device of claim 1, further comprising: a hood covering at least one of the inlet channel and the outlet channel, wherein the hood includes a removeable hatch to allow access to selectively remove the first filter element.

8. The molten metal filter device of claim 7, further comprising a heating element disposed within the hood and overhead at least one of the inlet channel and the outlet channel.

9. The molten metal filter device of claim 1, wherein first filter element is operable to filter a molten an Aluminum-Silicon (Al—Si) alloy and includes a pore size sufficient to remove particles size of greater than about 20 microns.

10. The molten metal filter device of claim 9, wherein the first filter element comprises at least one of a zirconium silicate, zirconium oxide, and silicon carbide.

11. The molten metal filter device of claim 1, the flow of molten metal through outlet channel is in thermal communication with the flow of molten metal through the inlet channel to enable a continuous molten metal flow through the first filter element.

12. The molten metal filter device of claim 1, wherein first filter element is operable to filter a molten an Aluminum alloy free of Silicon and includes a pore size sufficient to remove particles size of greater than about 5 microns.

13. A molten metal filter system, comprising:

a holding tank operable to receive a molten metal;

a filter device comprising a chamber, an inlet channel operable to receive the molten metal from the holding tank and convey a flow of molten metal into the chamber, and an outlet channel operable to convey the flow of molten metal out of the chamber and back into the holding tank;

a pump operable to move the molten metal from the holding tank through the inlet channel; and a plurality of removeable filters disposed in series within the inlet channel, wherein the plurality of removable filters are operable to remove inclusions above a determined diameter size from the molten metal;

wherein at least one of plurality of removeable filters includes a form factor occupying a cross-section of the inlet channel perpendicular to a direction of the flow of molten metal through the inlet channel wherein the filter device further comprises a heat conductive partition wall disposed between the inlet channel and the outlet channel; and wherein the outlet channel is operable to convey the flow of molten metal in a direction counter-current to the direction of the flow of molten metal through the inlet channel.

14. The molten metal filter system of claim 13, wherein at least one of the plurality of removeable filters includes at least one of a zirconium silicate, zirconium oxide, and silicon carbide, and a pore size sufficient to remove particles size of greater than about 20 microns.

15. The molten metal filter system of claim 13, wherein the filter device includes at least one nozzle operable to direct an inert gas flow into at least one of the inlet channel and the outlet channel to blanket the molten metal.

16. The molten metal filter system of claim 13, wherein the chamber is accessible to transfer a filtered molten metal from the chamber to a casting device.

17. A continuous flow molten metal filter system, comprising:

a filter device operable to filter a molten casting alloy to produce a filtered molten casting alloy; and a casting device operable to receive the filtered molten casting alloy to form a solidified casting;

wherein the filter device comprises:

an inlet channel;

a chamber downstream of the inlet channel; and an outlet channel downstream of the inlet channel;

a heat conductive partition wall disposed between the inlet channel and the outlet channel; and at least one removable filter disposed in the inlet channel;

wherein the at least one removeable filter includes a form factor occupying a cross-section of the inlet channel perpendicular to a direction of a flow of molten metal through the inlet channel; and wherein the outlet channel is operable to convey the flow of molten metal in a direction counter-current to the direction of the flow of molten metal through the inlet channel.

18. The continuous flow molten metal filter system of claim 17, further comprising a pump operable to continuously recirculate at least a portion of the filtered molten casting alloy through the inlet channel, the chamber, and the outlet chamber.

19. The continuous flow molten metal filter system of claim 17, wherein the filter device includes at least one nozzle operable to direct an inert gas flow into at least one of the inlet channel and the outlet channel to blanket the molten casting alloy.

20. The continuous flow molten metal filter system of claim 17, wherein a portion of the filtered molten casting alloy is transferable from the chamber to the casting device.

* * * * *